US005442366A

United States Patent [19]

Sanford

[11] Patent Number: 5,442,366

[45] Date of Patent: Aug. 15, 1995

[54] RAISED PATCH ANTENNA

[75] Inventor: Gary G. Sanford, Boulder, Colo.

[73] Assignee: Ball Corporation, Muncie, Ind.

[21] Appl. No.: 91,175

[22] Filed: Jul. 13, 1993

[51] Int. Cl.[6] ..... H01Q 1/27

[52] U.S. Cl. ..... 343/700 MS; 343/846

[58] Field of Search ..... 343/700 MS, 820, 846

[56] References Cited

U.S. PATENT DOCUMENTS

| | | | |
|---|---|---|---|
| 3,295,137 | 12/1966 | Fenwick et al. | 343/787 |
| 3,478,362 | 11/1969 | Ricardi et al. | 343/769 |
| 4,605,933 | 8/1986 | Butscher | 343/700 MS |
| 4,706,050 | 11/1987 | Andrews | 343/700 MS |
| 4,827,266 | 5/1989 | Sato et al. | 343/700 MS |
| 5,061,938 | 10/1991 | Zahn et al. | 343/700 MS |
| 5,061,939 | 10/1991 | Nakase | 343/700 |
| 5,200,756 | 4/1993 | Feller | 343/700 MS |
| 5,243,354 | 9/1993 | Stern et al. | 343/700 MS |

*Primary Examiner*—Donald Hajec
*Assistant Examiner*—Tho G. Phan
*Attorney, Agent, or Firm*—Gilbert E. Alberding

[57] ABSTRACT

A raised patch antenna is disclosed which includes a base having a ground plane, a plurality of leg supports interconnected to and extending upwardly to the base, a raised patch antenna element supportedly interconnected to the leg supports and positioned over the ground plane and an RF feed comprising a feed-leg portion provided on the leg supports and a feed base portion provided as a part of the base. The RF feed includes impedance matching components for matching the impedance of the feed base portion with the impedance with the raised patch antenna element in series with the feed-leg portion. The feed-leg portion comprises at least a first pair of balanced feed-leg lines interconnected to opposing sides of the raised patch antenna element. Baluns can be provided in said feed base portion for balancing. For circularly polarized applications, a second pair of balance feed-leg lines are interconnected to second opposing sides of the raised patch antenna element for excitation of orthogonal modes, and a phasing means is provided in the feed base portion for achieving phase quadrature. The antenna yields broad overhead coverage and satisfactory bandwidth, and can be economically and readily produced.

19 Claims, 9 Drawing Sheets

RAISED PATCH ANTENNA

FIELD OF THE INVENTION

The present invention pertains to a raised patch antenna which provides broad overhead coverage and satisfactory bandwidth, and which can be economically and readily produced.

BACKGROUND OF THE INVENTION

As the performance of antennas improves and costs are reduced, the potential applications for antennas rapidly increase. With the development of extensive satellite communication systems, the potential applications for antennas providing a broad overhead beamwidth are particularly apparent.

Specifically, the applications for mobile, ground-based antennas capable of transceiving circularly polarized signals are numerous. For example, such antennas can be deployed on fleets of vehicles to provide positional and other field information via satellite to a central location and/or to each other on a rapidly updated basis. For many remaining applications, however, the feasibility of implementing antenna systems will depend upon the achievement of even lower production costs.

Microstrip patch antennas have been successfully employed to address many overhead coverage needs. In order for such antennas to achieve required bandwidths for many evolving applications, however, the required dielectric structure becomes so thick as to be impractical.

While dipole arrangements have also been employed to provide overhead coverage, significant manufacturing costs are entailed for the feed system, particularly in applications requiring the transmission of circular polarized signals. In such situations, constant spacing between the feedlines and interconnections to dipole elements is critical and the manufacturing tolerances are therefore extremely tight.

SUMMARY OF THE INVENTION

Accordingly, it is an object of the present invention to provide an antenna which yields broad overhead coverage and satisfactory bandwidth, and which can be readily produced.

A further object of the present invention is to provide an antenna having a relatively small size and otherwise displaying low mutual coupling for phased array applications.

More particularly, it is an object of the present invention to provide an antenna which is capable of circularly polarized signal transmission, which has a 3 dB bandwidth of about 120° or more and a 2:1 VSWR bandwidth of at least about 8 percent, and which has low material/production cost requirements.

In addressing such objectives it was recognized that, in order to raise an antenna patch element beyond about 0.03 wavelength from an underlying ground plane and avoid a monopole-like pattern, the patch should be fed as a balanced structure with opposing feed-leg lines (e.g., with two or more opposed, upwardly-extending feed-leg lines interconnected to the raised patch element to provide signals of equal amplitude and 180° out of phase). Relatedly, it was discovered that as the patch antenna element is raised beyond about 0.07 wavelength in height, its impedance becomes dominated by the impedance of the feed-leg lines in series with the patch element.

Understanding this, it was further recognized that for such raised patch antennas the ultimate antenna resonance will depend upon the patch element impedance in series with the feedline impedance, and that the desired impedance match can be established by matching the impedance of the patch element and the balanced, series feed-leg lines with the rest of the feed system. By virtue of this approach, a relatively small patch element can be provided to obtain broad beamwidth and satisfactory bandwidth. Such approach also accommodates material and production cost reduction since the dielectric body can be air or inexpensive, low dielectric structures (e.g., fiberglass) and since the conductive elements can be provided using relatively inexpensive materials and processes.

In accordance with the present invention, a raised patch antenna is disclosed comprising a base having a ground plane, a plurality of leg supports interconnected to and extending upwardly from the base, a raised patch antenna element supportedly interconnected to said leg supports and positioned over said ground plane, and feed means for transmitting signals to and from said raised patch antenna element. The feed means comprises a feed-leg portion provided on said leg supports so as to feed the patch element as a balanced structure, and a feed base portion interconnected with said base. The feed means further includes impedance matching means for matching the impedance of the feed base portion with the impedance of said raised patch antenna element in series with said feed-leg portion. Such impedance matching means includes series capacitive means and series inductive means provided as a part of the feed base portion and/or feed-leg portion. In the latter respect, the capacitive means can be advantageously positioned within the feed-leg portion for frequency tuning purposes.

Preferably, the feed-leg portion comprises a first pair of balanced feed-leg lines interconnected to first opposing sides of the raised patch element (e.g. a square patch) for supplying a balanced first feed signal thereto (e.g., for linearly polarized signals). For balancing, a balun (e.g., a one-half $\lambda$ transmission line) may be provided as part of the feed base portion between the first pair of feed-leg lines. To transmit circularly polarized signals, the feed-leg portion further comprises a second pair of balanced feed-leg lines interconnected to second opposing sides of the raised patch antenna element for providing a balanced second feed signal thereto. Again, a balun may be utilized for balancing the second pair of feed-leg lines. A power divider means and phasing means (e.g., quadrature hybrid) are interconnected between a main feed supply and the first and second pairs of balanced feed-leg lines (e.g., by connection with the corresponding baluns) for establishing a 90° phase difference between the first and second balanced feed signals supplied to the raised antenna patch element.

Preferably, the aforementioned series inductive means is provided as a part of the feed-leg portion in the form of feed-leg lines having at least a portion which tapers down to a reduced end at or near the interconnection with the feed base portion (e.g., an inverted triangle). Such a structure yields low inductance and a workable impedance so as to allow for height reduction while maintaining bandwidth.

Relatedly, it is preferable to provide the aforementioned series capacitive means as a part of the feed-leg portion, interposed between the feed base portion and any inductive means located in the feed-leg portion. For example, a first upwardly extending feed-leg line portion may be directly interconnected at a bottom end with a feed pad of the feed base portion and capacitively interconnected at a top end to a second portion of the feed-leg line. In that arrangement, a shunt capacitance interconnection can also be provided between each feed-leg line and the feed base portion for adjusting the center frequency; e.g., the bottom end of a second feed-leg line portion may be directly interconnected with a shunt pad of the feed base portion that is spaced from a feed pad of the feed base portion. The series capacitive means can also be readily provided as a part of the feed base portion. For example, a chip capacitor can be utilized or capacitive components can be defined on a substrate by etching (e.g., a small octagonal structure surrounding and separated from a small cross-like structure to which the feed-leg portion(s) are interconnected). In the latter respect, to reduce shunt capacitance, small portions of the ground plane opposing the series capacitive components can be removed.

From a production standpoint, the raised antenna patch element and feed-leg portion can be advantageously integrally defined. For example, the patch element and feed-leg portion, as well as capacitive and/or inductive means, can be integrally defined by a metallization applied to a common support structure. Such structure may comprise, for example, a thin, inexpensive flexible substrate, such as mylar, kapton, polyester or polyimide, upon which the patch and feed-leg portions are etched with the substrate in a flat condition; followed by folding of the substrate to define the upstanding feed-leg portion and raised patch. Alternatively, for enhanced structural stability, and desirable pick-and-place production considerations, the support structure may comprise a fairly rigid, hollow cube (e.g., injection-molded plastic), upon which patch element and feed-leg portion metallizations are disposed. Additionally, it should be recognized that the antenna patch element and feed-leg portion may be integrally defined by stamping a desired pattern from a metal sheet and bending the same to integrally define the upstanding support legs and the feed-leg portion, as well as the raised patch antenna.

Similarly, the present invention allows for the realization of production benefits by integrally defining components of the feed base portion. For example, the aforementioned first and second baluns, phasing and power dividing means, and impedance matching means can be integrally defined by printing or etching on a conventional circuit board. Relatedly, it should be appreciated that in the present invention, the base (e.g., a circuit board within the feed base portion) does not effect or control the resonance of the raised antenna patch element, and therefore its dielectric constant can be specified with relatively loose tolerance, thereby allowing for cost reduction. To conserve space, it has also been recognized that the feed base portion components can be positioned on a base such that the raised patch antenna element is positioned substantially thereover with the feed-leg portion(s) interconnected at peripheral points.

Without limiting the potential scope of the present invention, it is currently contemplated that the invention can be successfully applied in designs wherein the antenna patch element is disposed from 0.07 wavelength to 0.30 wavelength above the ground plane, and wherein a square patch antenna is from 0.18 wavelength to 0.6 wavelength per side.

DETAILED DESCRIPTION

Figure 1:
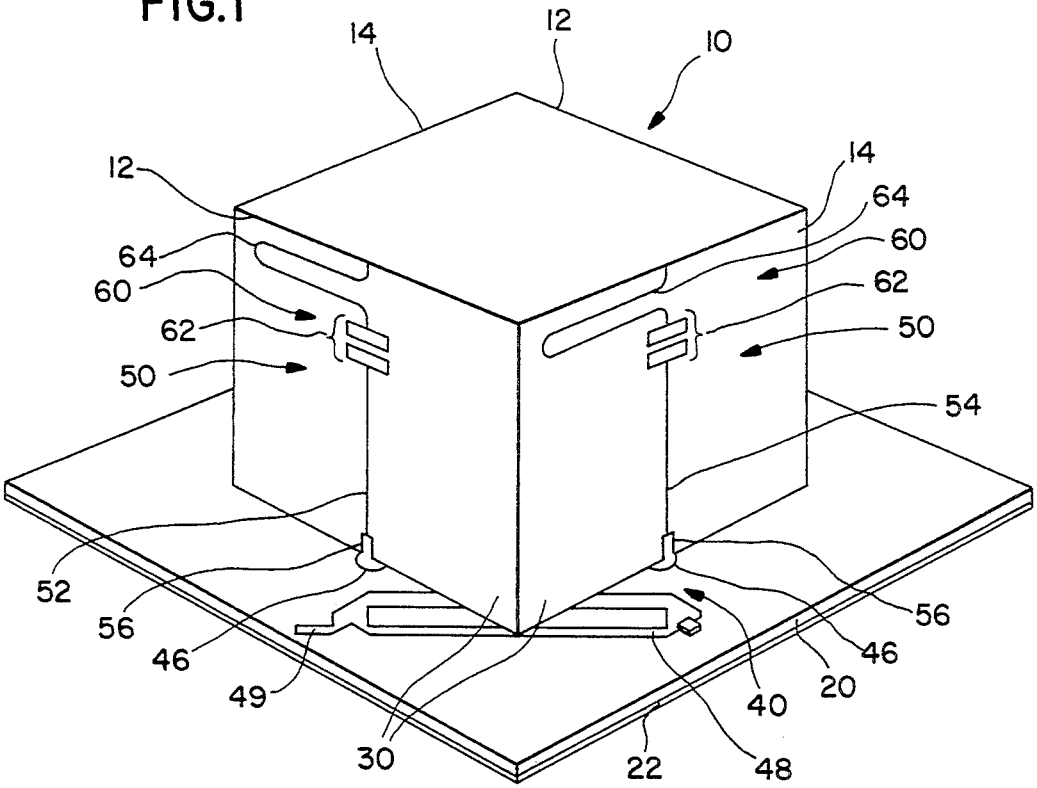
FIG. 1 is a perspective view of one embodiment of the present invention.
Figure 2:
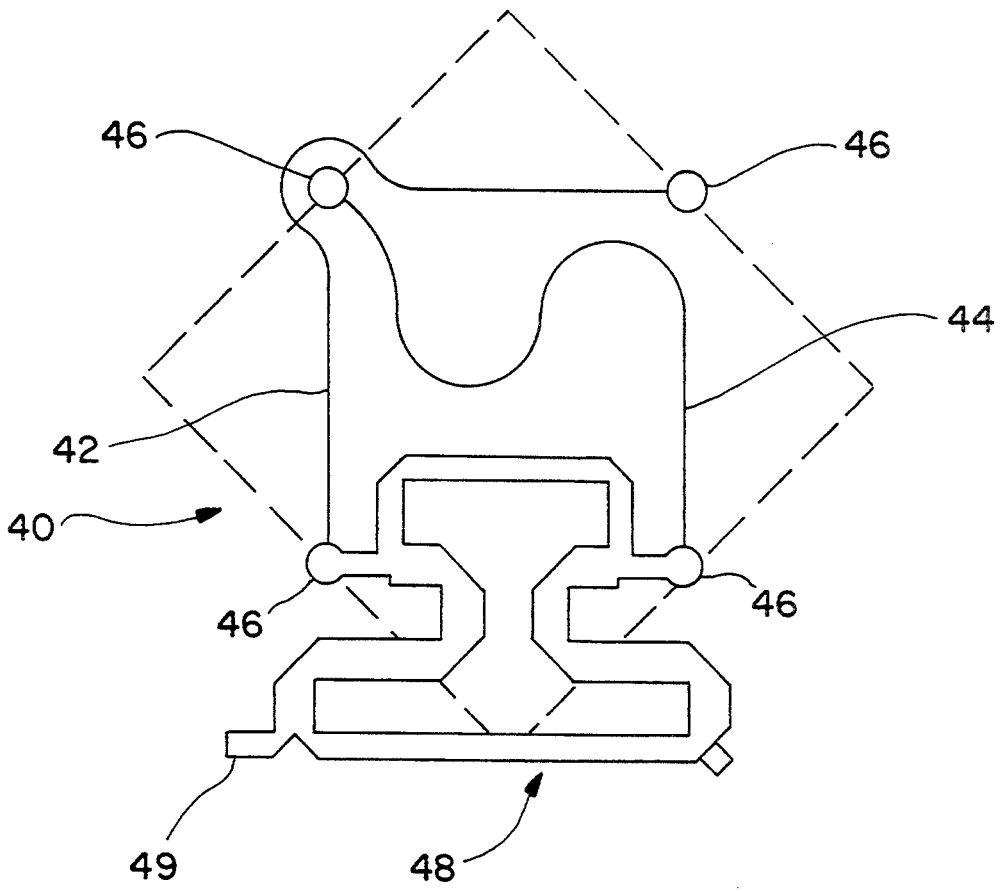
FIG. 2 is a top view of the feed base portion of the embodiment of FIG. 1.

FIGS. 1 and 2 illustrate an embodiment of the present invention intended for circularly polarized signal transmission and reception in which a raised patch antenna element 10 is supported above a base 20 and ground plane 22 by support legs 30. The antenna patch 10 is fed by a feed base portion 40 provided on the base 20 and an interconnected feed-leg portion 50 provided on the support legs 30.

Figure 1A:
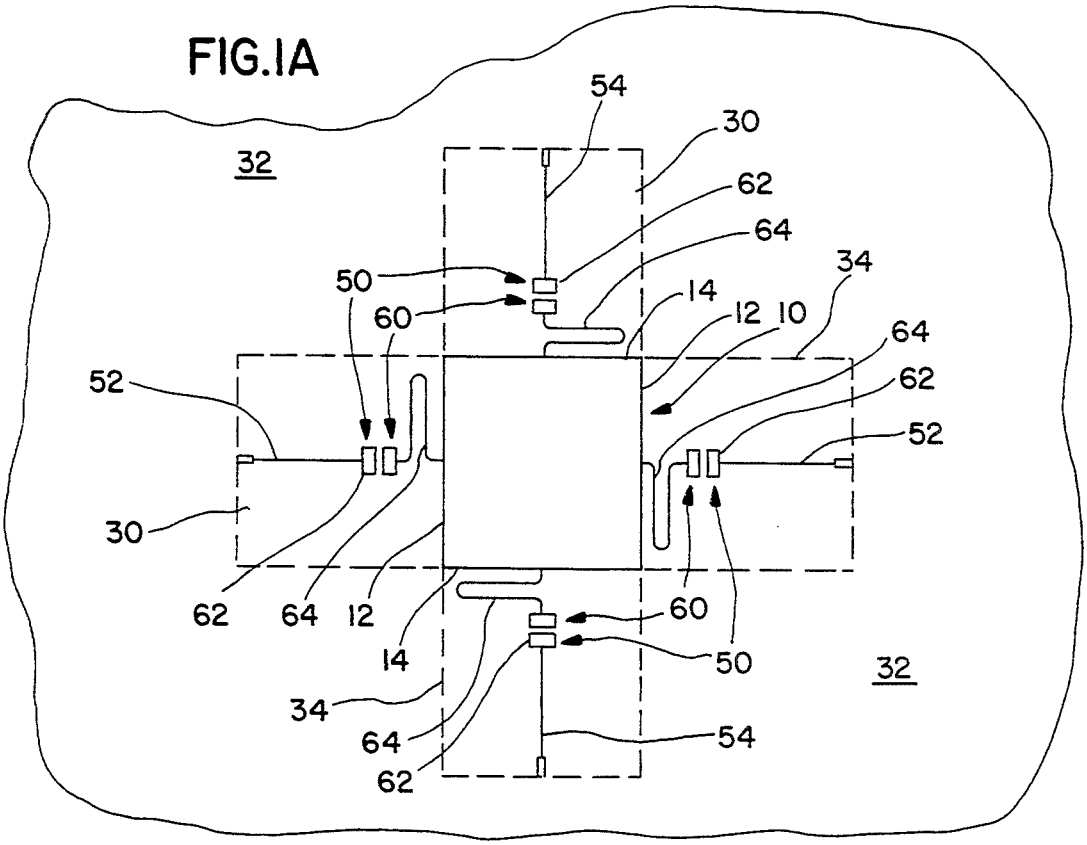
FIG. 1A is a plan view of a patch antenna element and feed-leg portion as integrally defined in one method of production of the present invention.

The support legs 30 are provided as four sides of a hollow, cube-like structure upon which antenna element 10 and feed-leg portion 50 are integrally defined (e.g., via metallization). Such cube-like structure can be of injection-molded plastic construction to yield structural stability and allow for automated pick-and-place production techniques. Alternatively, and as shown in FIG. 1A, the patch antenna element 10 and feed-leg portion 50 can be conveniently defined (e.g., by etching) on a flat, inexpensive flexible substrate 32 (e.g., mylar, kapton, polyester and polyimide) upon which a cube pattern 34 is also defined. The cube pattern 34 is then cut out and the substrate is folded to define support legs 30 and a structure coinciding with that illustrated in FIG. 1.

For broad symmetrical beamwidth, the raised patch antenna element 10 is fed as a balanced structure. One way to accomplish this is to feed opposite sides of the patch antenna element 10 with balanced signals of equal amplitude and 180° out of phase. Thus, in the embodiment of FIGS. 1 and 2, feed-leg portion 50 includes a first pair of balanced feed-leg lines 52 interconnected to first opposing side edges 12 of the raised patch antenna element 10 for supplying first balanced feed signals thereto, and a second pair of balanced feed-leg lines 54 interconnected to second opposing side edges 14 of the raised patch antenna element 10 for supplying second balanced feed signals thereto. Feed-leg lines 52, 54 may each include a broadened pad 56 for interconnection with feed contact pads 46 included within the feed base portion 40 (e.g., by soldering). Balancing of the first and second pairs of feed-leg lines 52 and 54 is achieved by including within the feed base portion 40 first and second baluns 42 and 44, respectively. As illustrated, the first and second baluns 42 and 44 may comprise one-half wavelength transmission lines interposed between feed contact pads 46 and the first and second feed-leg lines 52 and 54, respectively.

The feed base portion 40 further comprises phasing means and power dividing means 48 (e.g. a quadrature hybrid) interconnected between a main feed supply input 49 and said first and second baluns 42 and 44 for establishing a 90° phase difference between said first balanced feed signals and said second balanced feed signals, as is necessary for transceiving of circularly polarized signals.

Impedance matching means 60 are provided in the feed-leg lines 52 and 54 for matching the impedance of the feed base portion 40 with the impedance of the raised patch antenna element 10 in series with the first and second feed-leg lines 52,54. Such impedance matching means 60 includes series capacitive components 62 such as two short, opposing parallel lines and series inductive components 64 such as folded lines. The capacitive components 62 are positioned within the feed-leg lines 52 and 54 as may be desired for center frequency tuning. For example, moving the capacitive components 62 closer to the interconnection pads 56 reduces the center frequency, while moving the capacitive components 62 towards the patch antenna 10, edges 12 and 14 increase the center frequency. Any adjustment of this nature may also require adjustment of the values for the capacitive components 62 and inductive components 64.

To transmit, a main feed signal is provided to the main feed supply 49 and is divided into first and second feed signals, 90° out of phase, by quadrature hybrid 48. The first feed signal is then provided to opposing side edges 12 of the raised patch antenna element 10 in a balanced fashion, employing first balun 42 and feed-leg lines 52. Similarly, the second feed signal is provided to opposing sides 14 of the raised patch antenna element 10 in a balanced fashion, employing second balun 44 and feed-leg lines 54. As noted, impedance matching is achieved in the described embodiment by utilizing impedance matching means 60 in the feed-leg lines 52 and 54.

Figure 3:
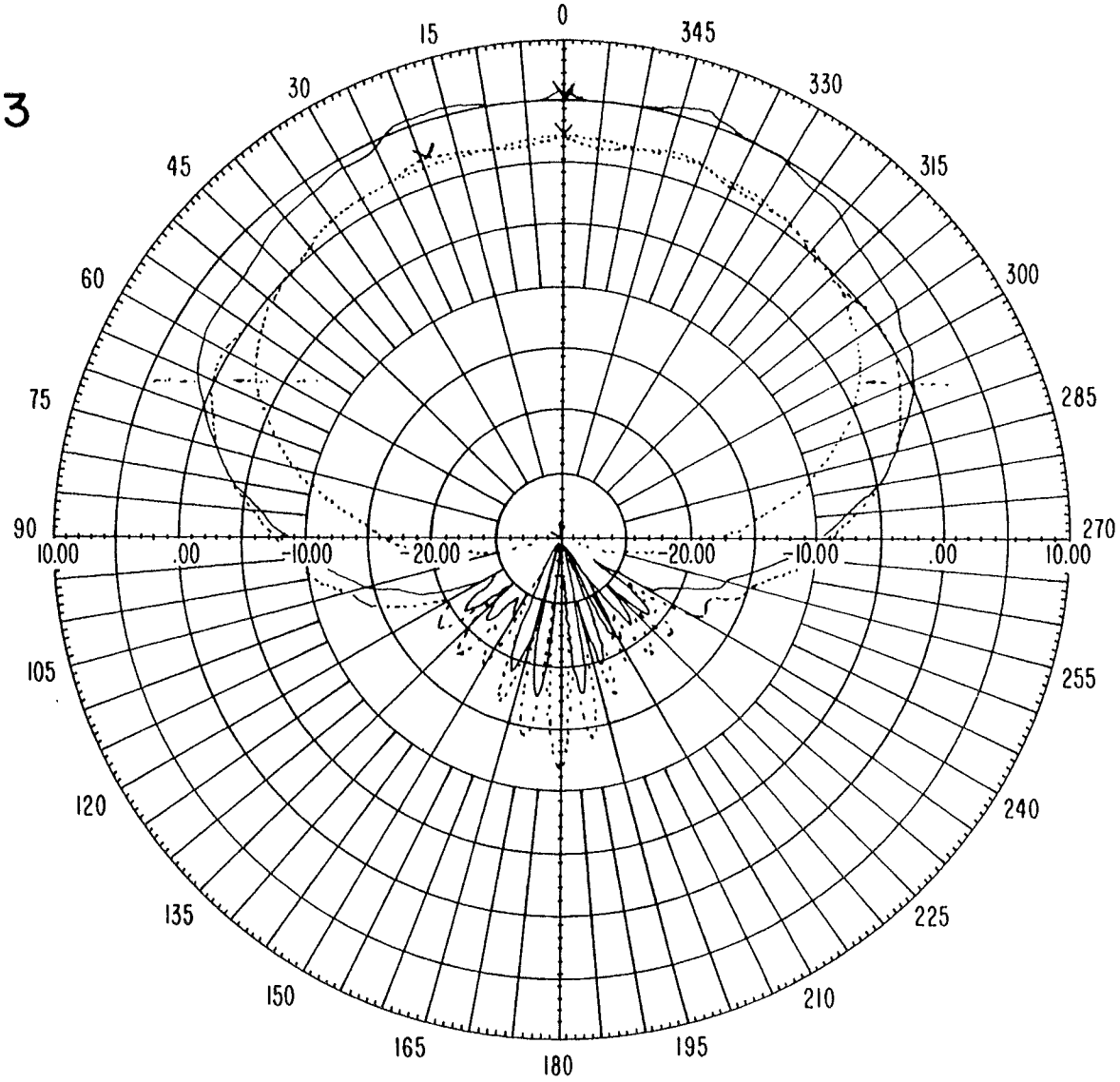
FIG. 3 shows a measured overhead radiation pattern of a prototype per the embodiment of FIGS. 1 and 2.
Figure 4:
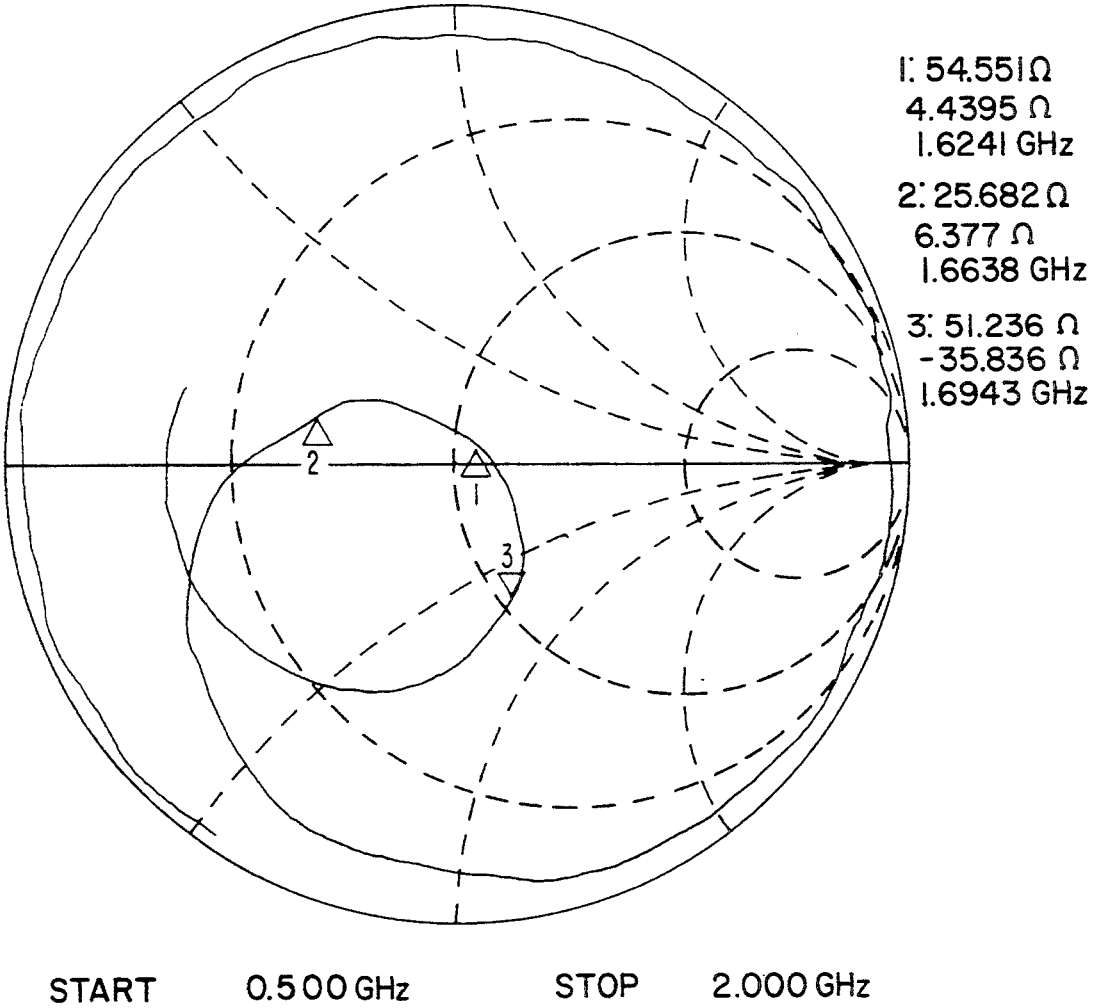
FIG. 4 shows a measured impedance plot of a prototype per the embodiment of FIGS. 1 and 2.

FIGS. 3 and 4 show a measured overhead radiation pattern and measured impedance plot of a prototype per the embodiment of FIGS. 1 and 2. In such prototype, each side of the support legs 30 defining the cube-like structure, as well as raised antenna patch element 10 was 1.35 inches, which translates to approximately 0.18 wavelength at a 1.6 GHz operating frequency. As shown by FIG. 4, the 3 dB beamwidth of the prototype was about 120° (the circular polarization signal is indicated by the solid plot and the horizontal and vertical components are indicated by the dashed plots). The FIG. 4 impedance plot of the prototype, measured with the quadrature hybrid 48 disconnected, reflects a 2:1 VSWR bandwidth of about 8%.

Figure 5:
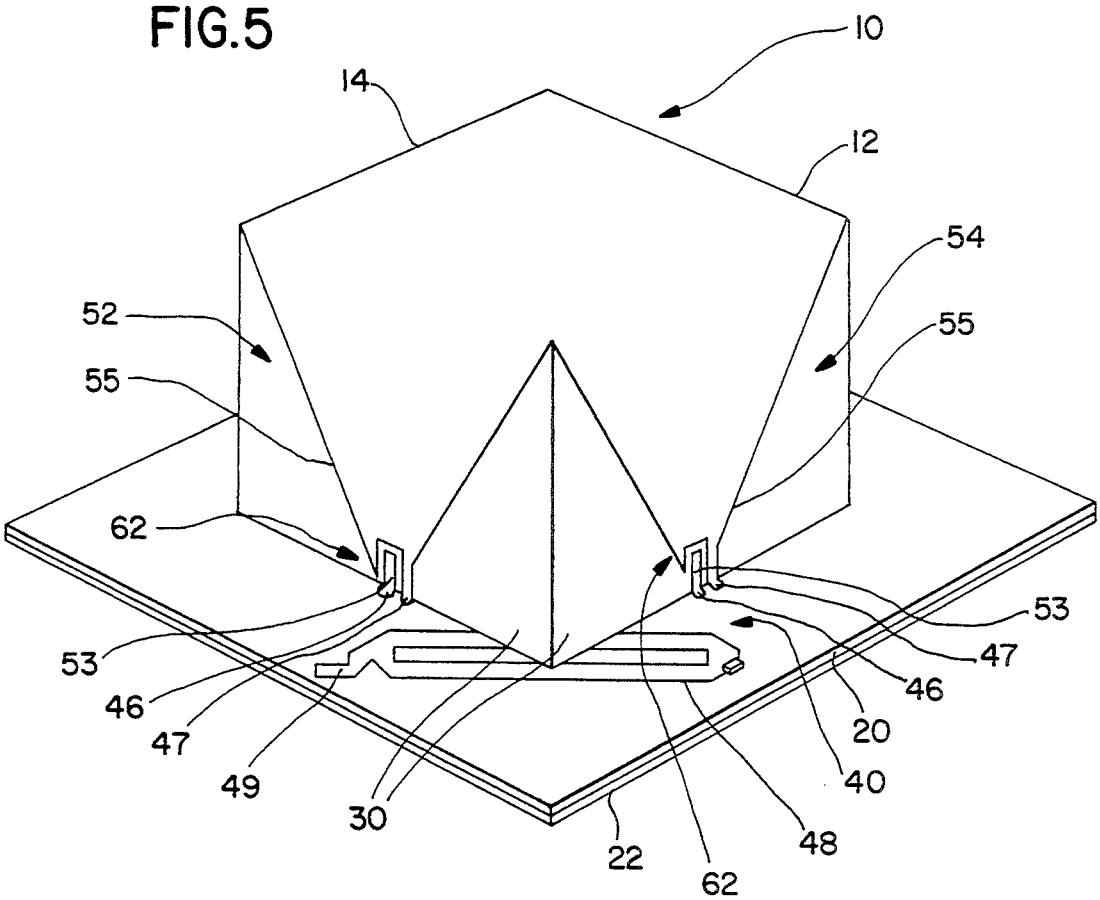
FIG. 5 is a perspective view of another embodiment of the present invention.
Figure 6:
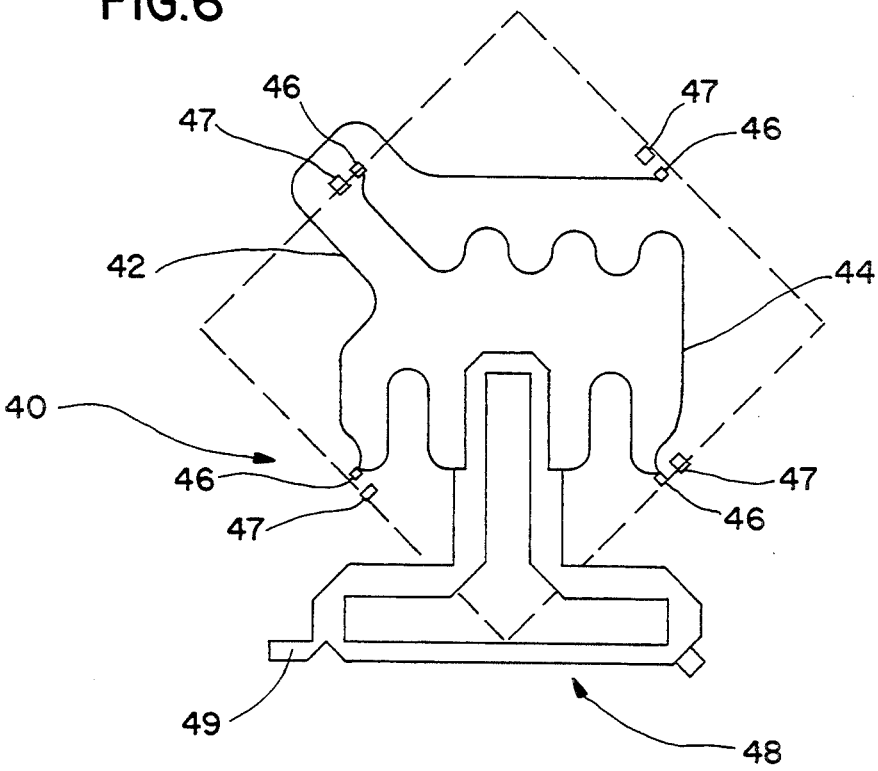
FIG. 6 is a top view of the feed base portion of the embodiment of FIG. 5.

FIGS. 5 and 6 show another embodiment of the present invention wherein the first and second pairs of balanced feed-leg lines 52 and 54, respectively, comprise triangularly defined metallizations, sized to provide the desired series inductance for impedance matching (e.g., generally, the larger the triangle size the less the inductance), interconnected to the antenna patch element 10 along opposing sides 12 and 14 and tapering to a dual interconnection with feed base portion 40.

Each of the balanced feed-leg lines 52 or 54 comprise a series capacitor 62 defined by a first portion 53 of each feed-leg lines 52,54 directly interconnected at a bottom end with a feed pad 46 of the feed base portion 40 and capacitively interconnected at a top end to a second portion 55 of the corresponding feed-leg lines 52 or 54. Additionally, a shunt capacitance interconnection is advantageously defined with a bottom end of the second portion 55 of the feed-leg lines 52 or 54 being interconnected to a shunt pad 47 of the feed base portion 40. The shunt pad 47 is spaced from the aforementioned feed pad 46 for center frequency adjustment.

Figure 7:
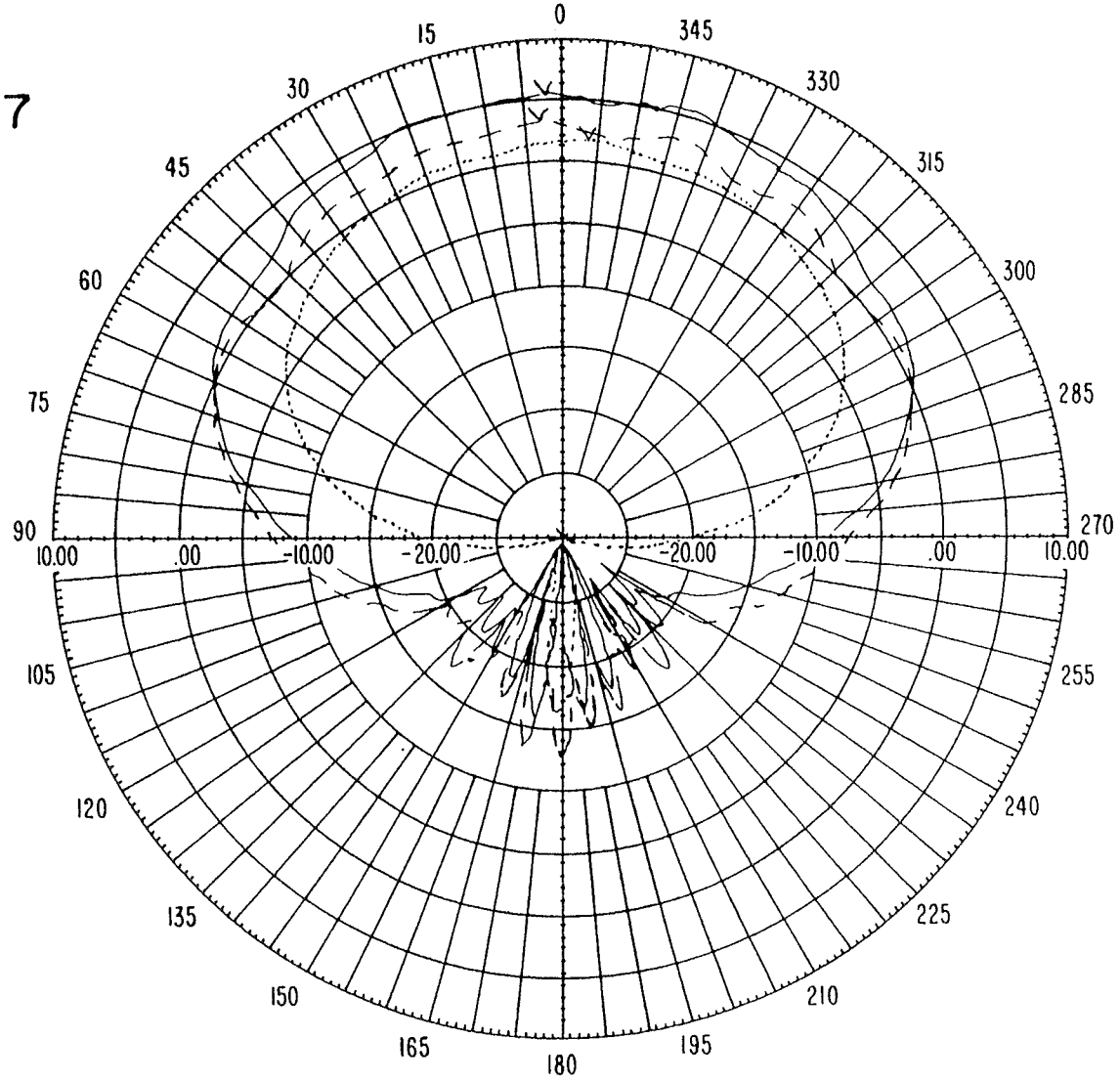
FIG. 7 shows a measured overhead radiation pattern of a prototype per the embodiment of FIGS. 5 and 6.
Figure 8:
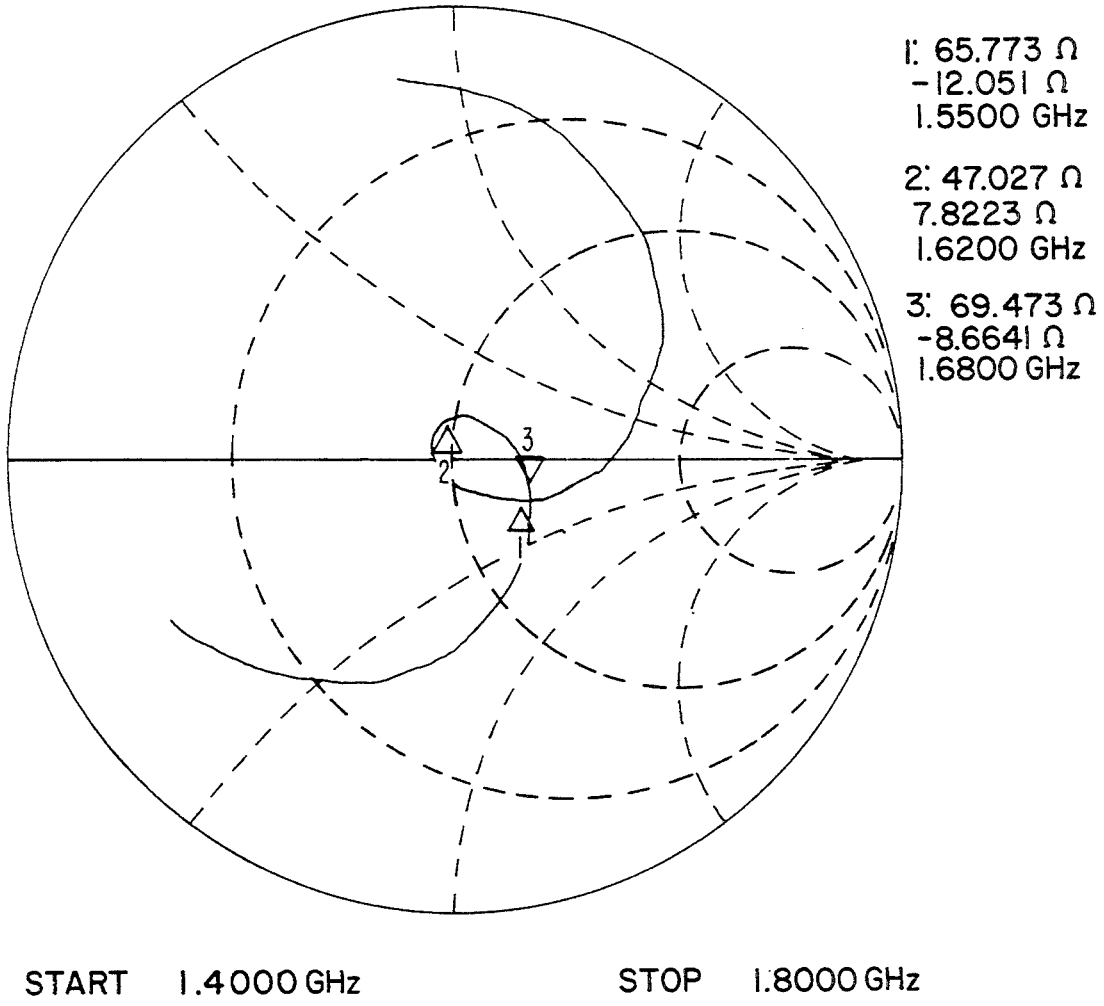
FIG. 8 shows a measured impedance plot of a prototype per the embodiment of FIGS. 5 and 6.

FIGS. 7 and 8 show a measured overhead radiation pattern and measured impedance plot of a prototype per the embodiment of the FIGS. 5 and 6. In such a prototype, the height of each side of the support legs 30 was reduced to 0.9 inch and each side at the square raised antenna patch element 10 was 1.35 inches. As shown by FIG. 7, the 3 dB beamwidth of the prototype was again about 120°. Significantly, the FIG. 8 impedance plot of the prototype, measured with the quadrature hybrid disconnected, reflects an improved VSWR (i.e., below 2:1) within and at both ends of the desired 8% bandwidth.

Figure 9:
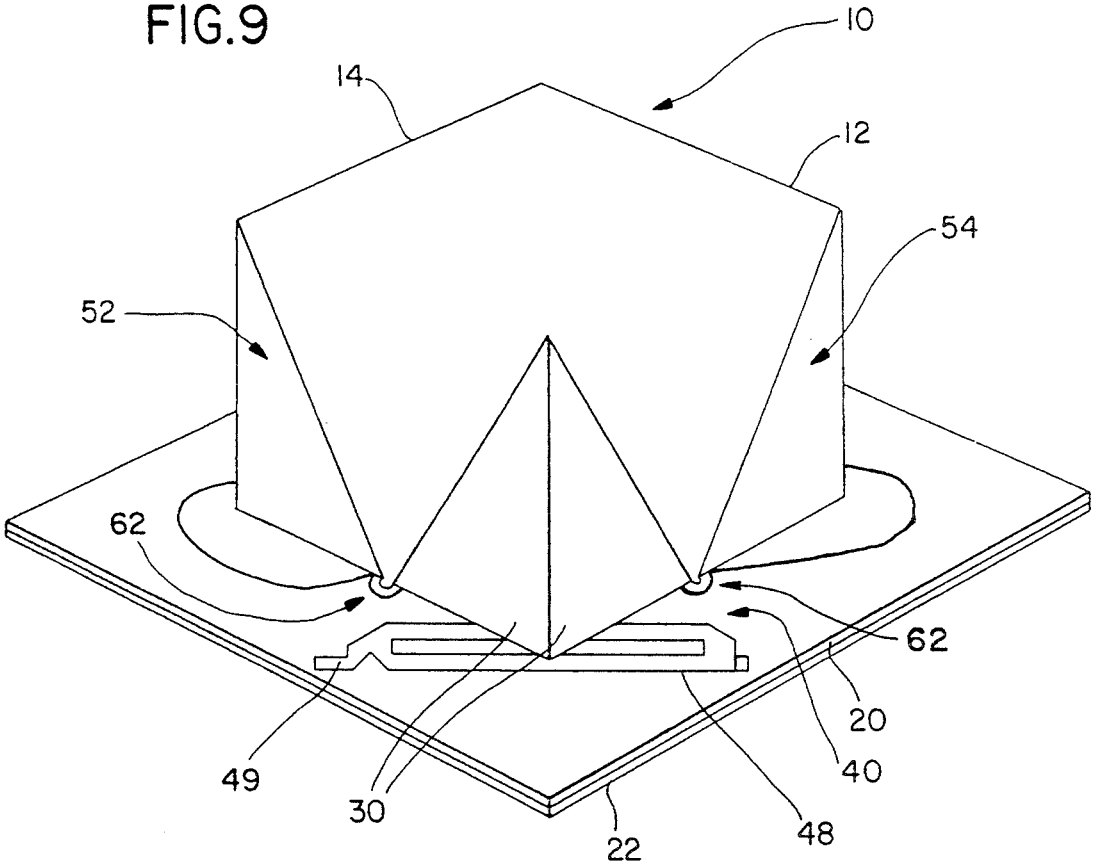
FIG. 9 is a perspective view of yet another embodiment of the present invention.
Figure 10:
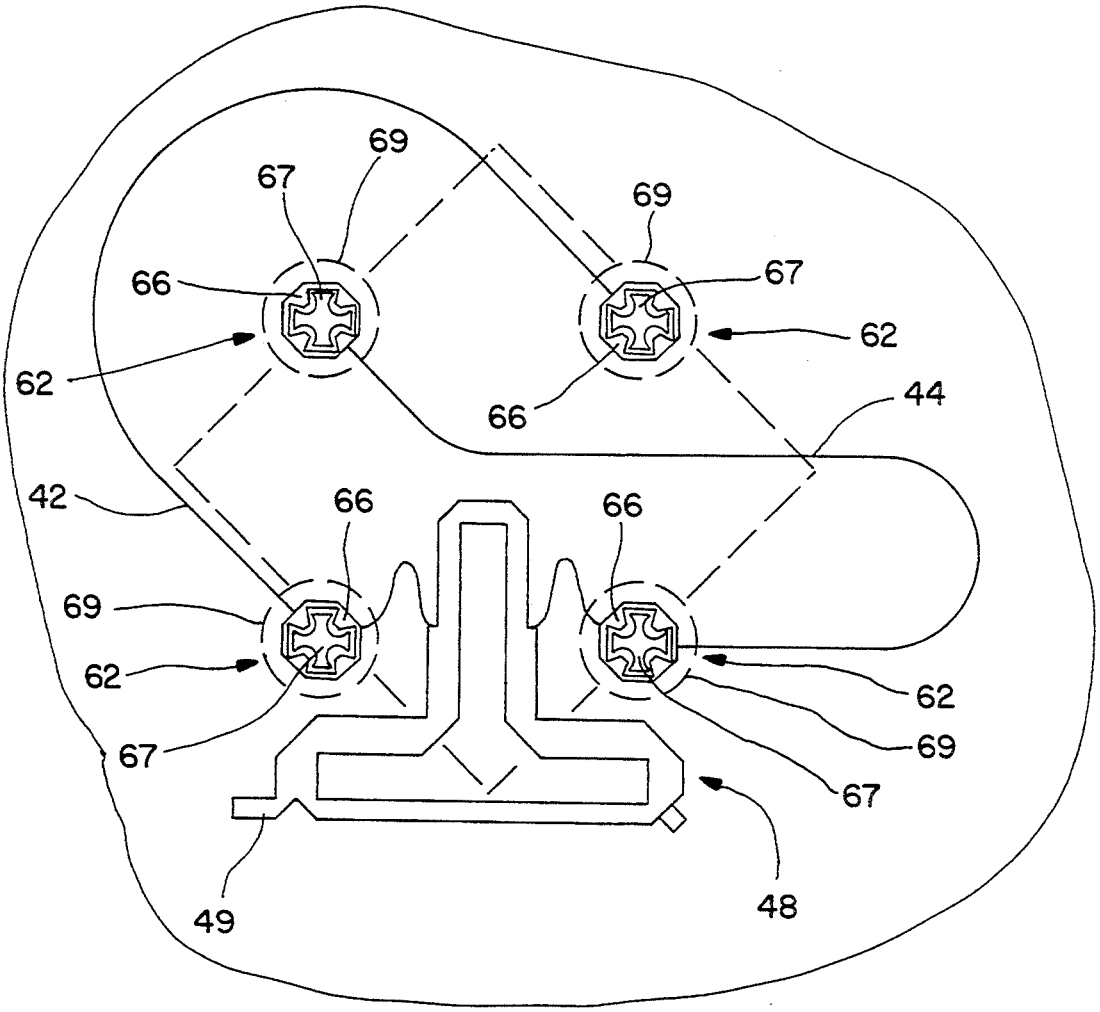
FIG. 10 is a top view of the feed base portion of the embodiment of FIG. 9.

FIGS. 9 and 10 show yet another embodiment of the present invention, wherein capacitive means 62 are readily provided as part of the feed base portion 40. Again, each of the first and second pairs of balanced feed-leg lines 52 and 54 comprise triangularly defined metallizations. Such triangular leg lines 52 and 54 each taper to a single direct interconnection to capacitive means 62 provided as a part of the feed base portion 40. As illustrated, such capacitive means 62 can be defined on base 20 by etching to provide a small, octagonal structure 66 surrounding and separated from a small, cross-like structure 67 to which the feed-leg lines 52,54 are directly interconnected. To reduce shunt capacitance, small portions 24 of the ground plane 22 opposing the capacitive means 62 can be removed (shown by dotted lines 69).

It is recognized that the raised antenna patch element 10 and first and second pairs of feed-leg lines 52 and 54 could be readily and integrally provided in a shape as per FIGS. 9 and 10 by stamping a symmetrical four point star shape from a metal sheet and bending the same to define edges 12 and 14 and a cube-like shape. Such an approach could yield manufacturing benefits and, if desired, would obviate the need for any underlying cube-like support structure since the metal legs would suffice. In such an arrangement, capacitive components could be interposed between the bottom of the legs 52, 54 and feed base portion 40, or alternatively could be defined as a part of the feed base portion 40.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A raised antenna comprising:

a base having a ground plane;

a plurality of leg supports interconnected to and extending upwardly from said base;

a raised patch antenna element supportedly interconnected to said leg supports and positioned over said ground plane;

feed means for transmitting signals to and from said raised patch antenna element and having a feed base portion and a feed-leg portion provided on said leg supports, said feed-leg portion including a first pair of balanced feed-leg lines interconnected to first opposing sides of said raised patch antenna element and a second pair of balanced feed-leg lines interconnected to second opposing sides of said raised patch antenna element; and impedance matching means for matching the impedance of said feed base portion with the impedance of said raised patch antenna element and said feed-leg portion.

2. A raised antenna, according to claim 1, said matching means comprising:

one of either a capacitive means or inductive means provided as a part of said feed base portion.

3. A raised antenna, according to claim 2, said matching means comprising:

both capacitive means and inductive means provided as a part of said feed base portion.

4. A raised antenna, according to claim 1, said impedance matching means comprising:

one of either capacitive means or inductive means provided as a part of said feed-leg portion.

5. A raised antenna, according to claim 4, wherein said capacitive means is further positioned within said feed-leg portion for frequency tuning.

6. A raised antenna, according to claim 4, said matching means comprising:

both capacitive means and inductive means provided as a part of said feed-leg portion.

7. A raised antenna, according to claim 1, wherein said raised antenna patch element and said feed-leg portion are integrally defined.

8. A raised antenna, according to claim 1, further comprising:

a support structure for supporting said raised antenna patch element and said feed-leg portion.

9. A raised antenna, according to claim 8, wherein said raised antenna patch element and said feed-leg portion are disposed directly upon said support structure.

10. A raised antenna, according to claim 1, said impedance matching means comprising:

a first feed-leg line portion interconnected at a bottom end to a feed pad within said feed base portion and capacitively interconnected at a top end to a second feed-leg line portion.

11. A raised antenna, according to claim 10, wherein said second feed-leg line portion is interconnected at a bottom end to a shunt pad spaced from said feed pad within said base portion and interconnected at a top end to said raised patch antenna element.

12. A raised antenna, according to claim 10, said second feed-leg line portion comprises inductive means.

13. A raised antenna comprising:

a base having a ground plane;

a plurality of leg supports interconnected to and extending upwardly from said base;

a raised patch antenna element supportedly interconnected to said leg supports and positioned over said ground plane;

feed means for transmitting signals to and from said raised patch antenna element and having a feed base portion and a feed-leg portion, said feed-leg portion being provided on said leg supports and including a first pair of balanced feed-leg lines interconnected to first opposing sides of said raised patch antenna element and a second pair of balanced feed-leg lines interconnected to second opposing sides of said raised patch antenna element.

14. A raised antenna, according to claim 13, said feed base portion further comprising:

a first balun interconnected between said first pair of feed-leg lines; and a second balun interconnected between said second pair of feed-leg lines.

15. A raised antenna, according to claim 14, said first and second baluns each comprising:

a one-half wavelength transmission line.

16. A raised antenna, according to claim 13, said feed base portion further comprising:

a main feed supply; and phasing means, interconnected between said main feed supply and said first and second pairs of balanced feed-leg lines, for establishing a 90° phase difference between a first feed signal supplied to said first pair of feed-leg lines and a second feed signal supplied to said second pair of feed-leg lines, wherein said antenna is capable of transmitting circularly polarized radiation.

17. A raised antenna, according to claim 16, said phasing means comprising:

a quadrature hybrid.

18. A raised antenna, according to claim 14, wherein said first and second baluns and said phasing means are positioned substantially under said raised patch antenna element.

19. A raised antenna, according to claim 16, wherein said feed base portion and said phasing means are integrally defined and disposed directly upon said base.

* * * * *